US008262351B2

(12) United States Patent
Clemen et al.

(10) Patent No.: US 8,262,351 B2
(45) Date of Patent: Sep. 11, 2012

(54) CASING STRUCTURE FOR STABILIZING FLOW IN A FLUID-FLOW MACHINE

(75) Inventors: Carsten Clemen, Mittenwalde (DE); Henner Schrapp, Berlin (DE)

(73) Assignee: Rolls-Royce Deutschland Ltd Co KG (DE)

( * ) Notice: Subject to any disclaimer, the term of this patent is extended or adjusted under 35 U.S.C. 154(b) by 822 days.

(21) Appl. No.: 12/379,204

(22) Filed: Feb. 17, 2009

(65) Prior Publication Data

US 2009/0208324 A1 Aug. 20, 2009

(30) Foreign Application Priority Data

Feb. 15, 2008 (DE) ..... 10 2008 009 604

(51) Int. Cl.
*F03D 11/02* (2006.01)

(52) U.S. Cl. ..... 415/220; 415/115; 415/57.4

(58) Field of Classification Search ..... 415/115, 415/57.4, 58.5, 58.7, 119, 173.1, 914
See application file for complete search history.

(56) References Cited

U.S. PATENT DOCUMENTS

| | | | | |
|---|---|---|---|---|
| 3,719,047 | A * | 3/1973 | Briotet et al. | 60/239 |
| 4,117,669 | A * | 10/1978 | Heller | 60/786 |
| 5,137,419 | A | 8/1992 | Waterman | |
| 5,466,118 | A | 11/1995 | Heinrich | |
| 5,797,414 | A * | 8/1998 | Sirovich et al. | 137/13 |
| 6,231,301 | B1 | 5/2001 | Barnett et al. | |
| 6,619,909 | B2 * | 9/2003 | Barnett et al. | 415/57.4 |
| 7,097,414 | B2 | 8/2006 | Strangeland | |
| 7,210,905 | B2 * | 5/2007 | Lapworth | 415/220 |
| 7,387,487 | B2 | 6/2008 | Guemmer | |
| 2003/0138317 | A1 | 7/2003 | Barnett et al. | |
| 2003/0152455 | A1 | 8/2003 | James | |
| 2004/0025504 | A1 * | 2/2004 | Perrin et al. | 60/602 |
| 2005/0111968 | A1 | 5/2005 | Lapworth | |

FOREIGN PATENT DOCUMENTS

| | | |
|---|---|---|
| DE | 103 55 241 A1 | 6/2005 |
| DE | 102007056953 | 5/2009 |
| EP | 0046173 | 2/1982 |
| EP | 0614014 | 9/1994 |

(Continued)

OTHER PUBLICATIONS

German Search Report dated Aug. 24, 2009 from counterpart German patent application.

(Continued)

*Primary Examiner* — Steven Loke
*Assistant Examiner* — David Goodwin
(74) *Attorney, Agent, or Firm* — Timothy J. Klima; Shuttleworth & Ingersoll, PLC

(57) ABSTRACT

A casing (2) includes at least one casing structure (casing treatment) for stabilizing a flow in an area of blade tips of rotor blades (4) in a fluid-flow machine, with the casing structure (casing treatment) being provided in at least one stage on an inner circumference of the casing (2). To provide a casing which improves compressor stability, is simply designed, features low weight and operates reliably without heating-up fluid in the fluid-flow machine, the casing structure is designed as a duct (20) which includes a first end (21) and a second end (22), with the first end (21) issuing into the interior of the casing (2) in the area of the blade tips of a rotor blade row and with the second end (22) being closed.

18 Claims, 3 Drawing Sheets

FOREIGN PATENT DOCUMENTS

| | | |
|---|---|---|
| EP | 1008758 | 6/2000 |
| GB | 2245312 | 1/1992 |
| GB | 2408546 | 6/2005 |
| WO | 9534745 | 12/1995 |

OTHER PUBLICATIONS

European Search Report dated Mar. 22, 2011 from the counterpart European patent application.

* cited by examiner

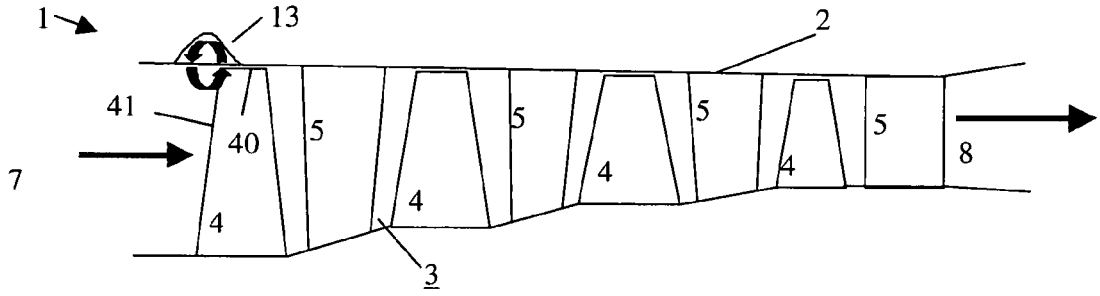
PRIOR ART
Fig. 3
Fig. 4a
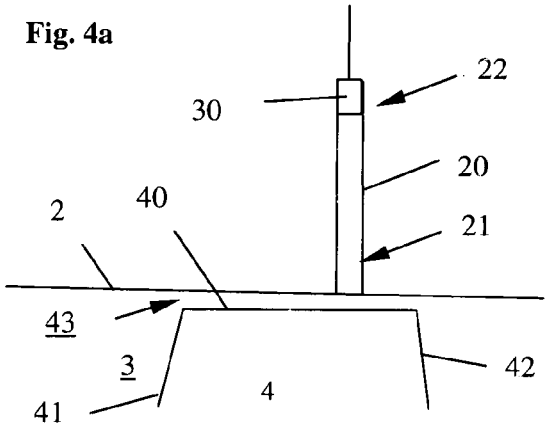
Fig. 4b
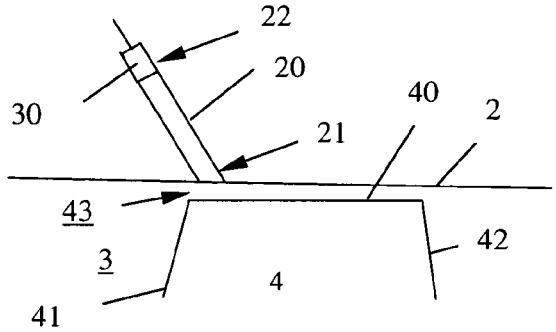
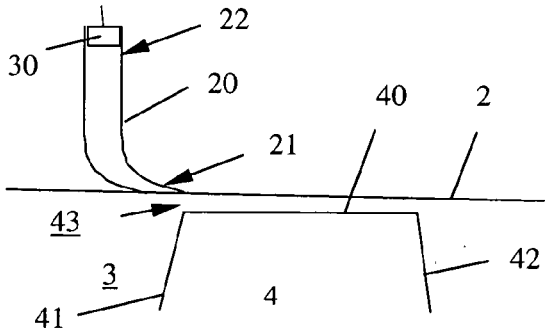
Fig. 4c
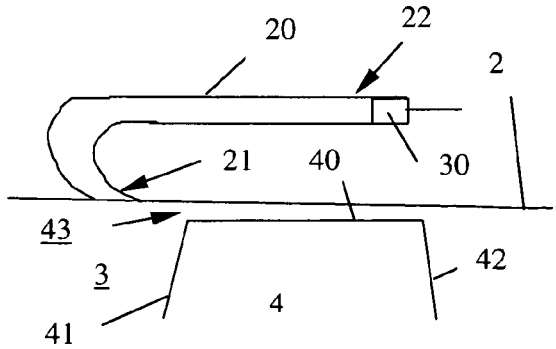
Fig. 4d

CASING STRUCTURE FOR STABILIZING FLOW IN A FLUID-FLOW MACHINE

This application claims priority to German Patent Application DE 102008009604.0 filed Feb. 15, 2008, the entirety of which is incorporated by reference herein.

The present invention relates to a casing with at least one casing structure (casing treatment) for stabilizing in an area of blade tips of rotor blades in a fluid-flow machine. Furthermore, the present invention relates to an application of the casing in a compressor of a gas turbine. Moreover, the present invention relates to a method for stabilizing the flow in the area of the blade tips of the rotor blades in a fluid-flow machine by use of the casing.

In a fluid-flow machine, in particular in a compressor, the pressure of a fluid is continuously increased by a rotor with rotor blades and a stator with stator vanes. The stability of the flow of the fluid in the compressor is here vital for the efficiency of the compressor and the service life of the blades. Therefore, an important objective in the development of compressors is the reduction of flow instabilities, as they occur particularly in blade tip flow-over of the rotor blades (gap flow), to improve the stability limit of the compressor.

Basically, two approaches exist to improve compressor stability, namely active and passive control.

Active control of compressor stability includes, for example, variable stator assemblies.

Figure 1:
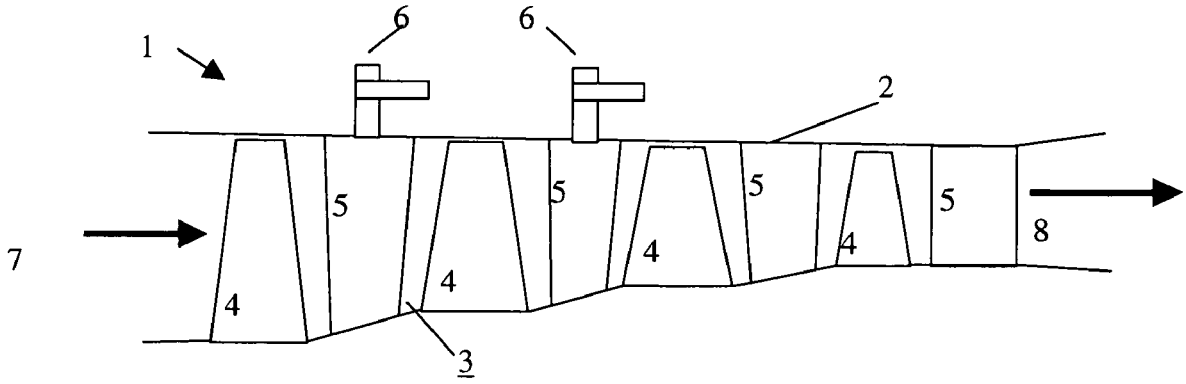
PRIOR ART Fig. 1

FIG. 1 schematically shows a compressor 1 of a jet engine (not shown) with a compressor casing 2, a compressor duct 3, rotor blades 4 and variable stator vanes 5 with actuating devices 6 according to the state of the art. Air 7 enters the compressor to leave it as compressed air 8. The mode of operation of the variable stator vanes 5 is characterized in that the inflow angle of the rotor blades 4 is altered as the speed of the compressor 1 changes, thereby modifying the inflow conditions such that the stability of the casing and profile boundary layers at the rotor blades 4 is maintained.

However, the design of variable stator vanes is very complex. A great number of individual parts are required, making the compressor heavy and expensive. In particular with jet engines, an increase in weight due to extra equipment is to be avoided. Also, the actuating devices are prone to failure. In consequence, both maintenance effort and costs are increased.

Also known as an active means of influencing compressor stability is the return of fluid from the rear stages of the compressor and injection thereof into the area of the blade tips of the forward rotor blades.

Figure 2:
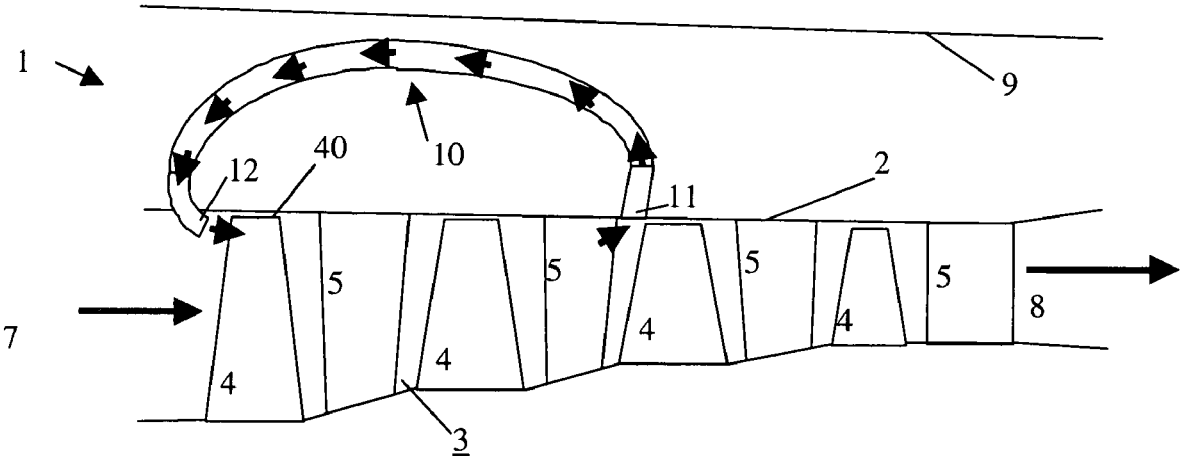
PRIOR ART Fig. 2

FIG. 2 shows a compressor 1 with a duct 10 for the return of a partial flow from a rearward compressor stage to a forward compressor stage, as known from practical application. The compressor 1 of a jet engine (not shown) is essentially provided with a compressor casing 2, a compressor duct 3, rotor blades 4 and stator vanes 5. Air 7 enters the compressor to leave it as compressed air 8. The duct 10 is disposed between the compressor casing 2 and the inner bypass casing 9 of the jet engine. Disposed behind a downstream compressor stage is a tapping point 11 which issues into the duct 10 leading to an injection point 12 located before an upstream compressor stage. According to the mode of operation of injection of fluid before or over the blade tips 40 of the rotor blades 4 of the first compressor stage, energy is introduced in the area of the blade tips 40 of the rotor blades 4, thereby positively influencing the gap flow between the rotor blades 4 of the first compressor stage and the compressor casing 2.

However, the speed-dependent return of fluid requires control using valves. This is very complex and unreliable. The return itself causes hot fluid to flow from the rearward to the forward portion of the compressor. The resultant increase of the temperature level in the compressor reduces efficiency.

Injection of fluid in the blade-near areas of a fluid-flow machine is known from Specification DE 103 55 241 A1, for example. In the Publication, individual nozzles are described which are specifically disposed on the casing and through which air is fed to the blade-near areas at different locations. The Publication further describes channels which pass through supply chambers and issue into the casing in the area of the blade tips. Through the supply chambers, fluid is supplied to the blade row. The fluid is supplied from either external sources or locations of the fluid-flow machine or the overall system including the fluid-machine.

Passive means of controlling the stability of the compressor include casing structures (casing treatments) in the form of small depressions provided before or above the blade tips of the rotor blades on the circumference of the compressor casing to influence blade tip flow-over.

FIG. 3 shows such a passive control. The compressor 1 of a jet engine (not shown) includes a compressor casing 2, a compressor duct 3, rotor blades 4 and stator vanes 5. The air 7 enters the compressor to leave it as compressed air 8. A depression 13 is provided at the leading edge 41 of the blade tip 40 of the first rotor blade 4. The flow in the area of the blade tip 40 is influenced in that the flow, by entering the depression 13 at the downstream end of the depression 13 and leaving the depression 13 at the upstream thereof, is circulated. This circulation is effected by the pressure being higher at the downstream end than at the upstream end of the depression 13. This pressure difference causes local recirculation of the flow. Thus, a small amount of energy is transported into the forward area of the blade tip 40. Flow recirculation in interaction with blade tip flow-over provides for stabilization of the gap flow and, thus, the compressor.

As the depressions are not speed-dependent, they can only be optimally designed for a specific operating point. Consequently, they are inadequate for improving stability under all operating conditions.

It is a broad aspect of the present invention to provide a casing, which, while being simply designed and featuring low weight, improves compressor stability and operates reliably without heating-up the fluid in the fluid-flow machine.

The present invention provides solution to the above problem by a casing with at least one casing structure (casing treatment) for stabilizing the flow in the area of the blade tips of the rotor blades in a fluid-flow machine, with the casing structure (casing treatment) being provided in at least one stage on the inner circumference of the casing. The casing structure is provided as a duct which has a first end and a second end, with the first end issuing into the interior of the casing in the area of the blade tips of a rotor blade row and with the second end being closed.

Static pressure fields, which form on the rotor blades, move past the duct and excite vibrations of the air column in the duct. At a certain speed, a standing wave forms in the duct. As a result, a pulsating mass flow is produced at the mouth of the duct which stabilizes the flow between the blade tips of the rotor blades and the casing.

This arrangement is simply designed and operates reliably. The duct does not increase the weight of the compressor. Nor will this arrangement lead to an increase in temperature of the flow in the compressor, in contrast to fluid return solutions, for example.

Preferably, the duct is provided with a constriction at the first end. The constriction increases the effect of the pulsating mass flow.

In particular, the length l of the duct at the second end is speed-dependably adjustable in a range between a minimum length $l_{min}$ and a maximum length $l_{max}$. This enables the natural frequency of the air column in the duct to be set to any operating condition of the fluid-flow machine. Accordingly, the casing according to the present invention combines the advantages of passive casing structures (casing treatments) by depressions in the casing (simple design, low weight, no return of hot fluid) with the advantages of active flow control by variable stators (speed-dependent control). With the length l of the duct being adjustable, future compressors can be designed with higher loaded rotor tips, which is obtainable, for example, by reducing the number of rotor blades. This leads to a reduction in weight and cost.

In a preferred embodiment of the present invention, the duct is rectilinear at least in the range between $l_{min}$ and $l_{max}$ and has a constant cross-section in this range, with a piston which is movable in the longitudinal direction of the duct between $l_{min}$ and $l_{max}$ being provided at the second end of the duct. The movable piston enables the length l of the duct to be simply adjusted. This piston arrangement is easily implementable, requires few parts and has less weight than a variable stator system according to the state of the art.

The position of the piston is controllable by means of an electric, hydraulic or pneumatic drive. For an electric drive, a stepping motor can be used, for example. These drives are reliable and easily installable in the fluid-flow machine.

In a preferred embodiment, the duct is arranged essentially radially to the inner circumference of the casing. Such a duct is easily producible by a casting core or by subsequent boring, for example.

In an alternative embodiment, the duct is arranged angularly to the longitudinal axis of the casing. Also such a duct is easily producible by a casting core or by boring.

In a further alternative embodiment, the duct is curvilinear outside of the range between $l_{min}$ and $l_{max}$. This embodiment enables the length of the duct to exceed the thickness of the casing wall.

In a further alternative embodiment, the duct is curvilinear in the area of the first end and parallel to the longitudinal axis of the casing in the range between $l_{min}$ and $l_{max}$. This arrangement is advantageous if the piston is to move in the axial direction.

In accordance with the present invention, the position of the first end of the duct is between the trailing edge of the rotor blade and a distance measured from the trailing edge of the rotor blade which is 1.3-times the axial chord length $l_{ax}$ of the rotor blade at the blade tip. This is the optimum span for stabilizing the flow between the blade tips of the rotor blades and the casing.

The casing is preferably used in a compressor of a gas turbine. Compressor stability is vital for a gas turbine. As the compressor is subject to high pressure and temperature loads, it shall not be additionally loaded by flow instabilities.

Furthermore, solution is provided by a method for stabilizing the flow in the area of the blade tips of the rotor blades in a fluid-flow machine by use of the casing, with a static pressure field forming on each rotor blade. The static pressure field moves past the first end of the duct during rotation of the rotor blade and excites vibrations of the fluid column in the duct, with a standing wave being produced in the duct by which a pulsating mass flow is created at the first end of the duct.

This method is based on a simple principle and is very reliable. The method provides for an increase of the compressor surge limit to be obtainable without affecting compressor efficiency and for the increase in surge limit to be optimally utilizable throughout the speed range of the compressor.

Preferably, the standing wave is produced in that the natural frequency of the fluid column is matched such to the blade passing frequency that the natural frequency of the fluid column concurs with a multiple of the blade passing frequency of the rotor blades. Matching the natural frequency of the fluid column enables the stability to be improved in all operating states of the fluid-flow machine.

Furthermore, the natural frequency of the fluid column can be speed-dependently set by adjusting the length l of the duct. By adjusting the length l of the duct, the natural frequency of the air column in the duct can be easily set.

The length l of the duct can be calculated using the formula $$l(n) = \left(\frac{1}{2}k + \frac{1}{4}\right)\frac{\sqrt{\kappa R}}{nz},$$

with l being the length of the duct, k any natural number,

κ the isentropic exponent,

R the specific gas constant, n the aerodynamic speed of the compressor rotor, and z the number of blades of the rotor blade row.

This formula enables the optimum length l of the duct to be precisely determined for each operating range. Adjustment of the length l of the duct in dependence of the aerodynamic speed of the compressor leads to a defined aerodynamic state existing in the duct at all times, thereby providing for maximum effectiveness of the duct and maximum increase in compressor stability. Since the aerodynamic speed is available to the engine computer, control of the length l of the duct is very simply and reliably implementable. With the length l of the duct being optimally matched to all speeds, improvement of compressor efficiency is also to be expected.

The minimum length $l_{min}$ of the duct can be calculated using the formula $$l_{min} = \left(\frac{1}{2}k_{min} + \frac{1}{4}\right)\frac{\sqrt{\kappa R}}{n_{max}z} \text{ with } k_{min} \leq k,$$

and with $l_{min}$ being the minimum length of the duct, $k_{min}$ any natural number, κ the isentropic exponent, R the specific gas constant, $n_{max}$ the maximum aerodynamic speed of the compressor rotor, and z the number of blades of the rotor blade row.

By specifying the minimum length provision is made that the duct length is not set too short.

The maximum length $l_{max}$ of the duct can be calculated using the formula $$l_{max} = \left(\frac{1}{2}k + \frac{1}{4}\right)\frac{\sqrt{\kappa R}}{n_{min}z},$$

with $l_{max}$ being the maximum length of the duct, k any natural number,

κ the isentropic exponent,

R the specific gas constant, $n_{min}$ the minimum aerodynamic speed of the compressor rotor, and z the number of blades of the rotor blade row.

By specifying the maximum length of the duct, provision is made that the duct is not set too long.

Figure 5:
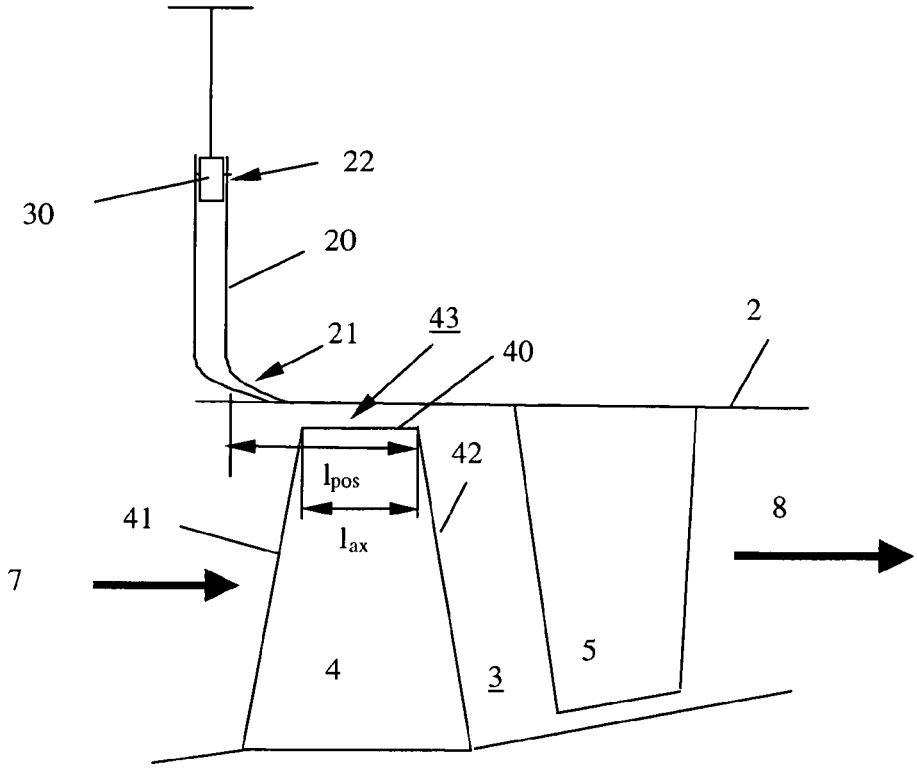
Figure 6:
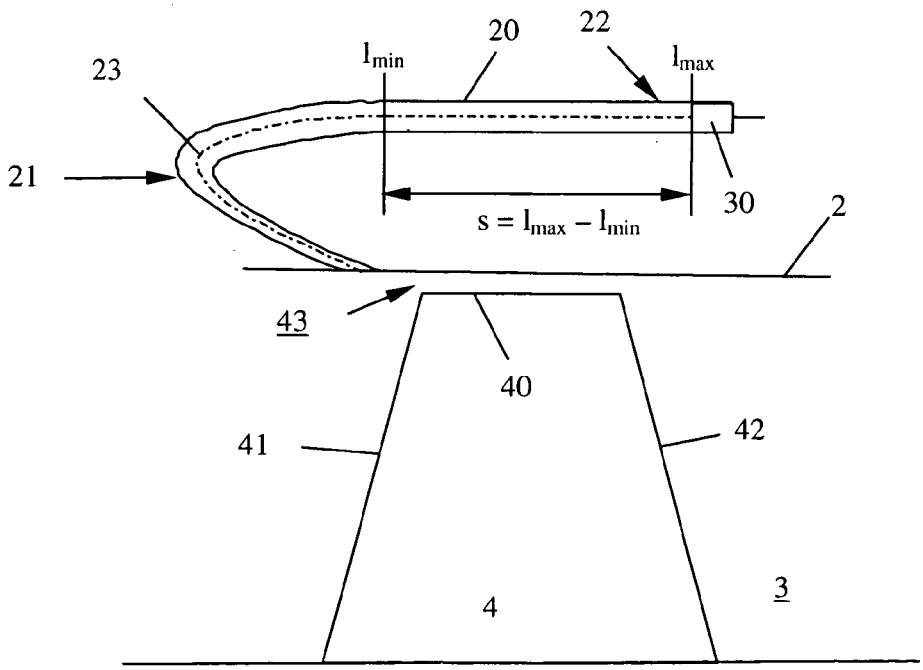

The present invention is more fully described in light of the accompanying drawings showing several embodiments. In the drawings, FIG. 1 (Prior Art) shows a compressor casing with variable stator vanes in accordance with the state of the art, FIG. 2 (Prior Art) shows a compressor casing with a duct for fluid return in accordance with the state of the art, FIG. 3 (Prior Art) shows a compressor casing with a casing structure (depression) in accordance with the state of the art, FIG. 4*a* is a schematic view of a first embodiment of a duct in a casing according to the present invention, FIG. 4*b* is a schematic view of a second embodiment of a duct in a casing according to the present invention, FIG. 4*c* is a schematic view of a third embodiment of a duct in a casing according to the present invention, FIG. 4*d* is a schematic view of a fourth embodiment of a duct in a casing according to the present invention, FIG. 5 is an enlarged schematic view of the third embodiment, and FIG. 6 is an enlarged schematic view of the fourth embodiment.

FIGS. 4*a*, 4*b*, 4*c* and 4*d* each show a portion of a casing in the form of a compressor casing 2 in a jet engine, a rotor blade 4 and a duct 20 with a piston 30.

The compressor casing 2 encloses the cross-sectionally circular compressor duct 3. In the compressor duct 3, rotor blades are radially arranged on a shaft or rotor disk. FIGS. 4*a-d* only show one rotor blade 4 each. The rotor blade 4 has a blade tip 40, an upstream leading edge 41 and a downstream trailing edge 42. In the compressor duct 3, a gap 43 exists between the blade tip 40 of the rotor blade 4 and the compressor casing 2.

In the compressor casing 2, the duct 20 is disposed in the area of the blade tip 40 of the rotor blade 4. The duct 20 has a first end 21 and a second end 22. The first end 21 of the duct 20 issues, in the area of the blade tip 40 of the rotor blade 4, into the compressor duct 3 or the gap 43, respectively. The second end 22 of the duct 20 is arranged at a clear distance from the first end 21 and closed by the variable piston 30. This duct 20 can be provided in alternative numbers, extensions and shapes in both the axial and circumferential directions. Any number of ducts 20 of the four embodiments shown in FIGS. 4*a-d* can be provided on the circumference of the compressor casing 2. In addition, further ducts 20 can be provided on the rotor blades of further compressor stages.

FIG. 4*a* shows the first embodiment of the duct 20 in the compressor casing 2. The duct 20 is rectilinear and extends radially to the inner circumference of the compressor casing 2. The first end 21 of the duct 20 issues into the gap 43 between the blade tip 40 and the compressor casing 2 in the downstream area of the blade tip 40 of the rotor blade 4.

FIG. 4*b* shows the second embodiment of the duct 20 in the compressor casing 2. The duct 20 is rectilinear and inclined at an acute angle to the longitudinal axis (not shown) of the compressor casing 2, with the corner of the angle showing in the direction of flow. The first end 21 of the duct 20 issues into the gap 43 between the blade tip 40 and compressor casing 2 in the upstream area of the blade tip 40 of the rotor blade 4.

FIG. 4*c* shows the third embodiment of the duct 20 in the compressor casing 2. The duct 20 is rectilinear and extends radially to the inner circumference of the compressor casing 2 only at the second end 22. The first end 21 of the duct 20 is curvilinear, constricts in the direction of the compressor duct 3 and issues upstream of the leading edge 41 of the rotor blade 4 into the compressor duct 3 shortly before the gap 43 between the blade tip 40 and the compressor casing 2.

FIG. 4d shows the fourth embodiment of the duct 20 in the compressor casing 2. The duct 20 is rectilinear and parallel to the longitudinal axis (not shown) of the compressor casing 2 only at the second end 22. The first end 21 of the duct 20 is curvilinear, constricts in the direction of the compressor duct 3 and issues upstream of the leading edge 41 of the rotor blade 4 into the compressor duct 3 shortly before the gap 43 between the blade tip 40 and the compressor casing 2.

FIG. 5 shows an enlargement of the third embodiment of the duct 20 in the compressor casing 2 according to FIG. 4*c*. Again shown are essentially the compressor casing 2 with the compressor duct 3, the rotor blade 4, a stator vane 5 and the duct 20 with the piston 30. An airflow 7 enters the compressor stage formed by the rotor blade 4 and the stator vane 5. The compressed airflow 8 leaves the compressor stage.

The duct 20 includes the first end 21 and the second end 22 in which the piston 30 is disposed. The rotor blade 4 includes the blade tip 40, the leading edge 41 and the trailing edge 42. Between the blade tip 40 and the compressor casing 2 is the gap 43. The axial distance between the leading edge 41 and the trailing edge 42 on the blade tip 40 is the chord length $l_{ax}$. The position of the duct 20 can lie within an area extending from the trailing edge 42 of the rotor blade 4 to 1.3-times the axial chord length $l_{ax}$, as measured from the trailing edge 42. This area is indicated by $l_{pos}$ in FIG. 5.

FIG. 6 shows an enlargement of the fourth embodiment of the duct 20 in the compressor casing 2 according to FIG. 4*d*. Again shown are essentially the compressor casing 2 with the compressor duct 3, the rotor blade 4 and the duct 20 with the piston 30. The duct 20 includes a centerline 23, the first end 21 and the second end 22 in which the piston 30 is disposed. The rotor blade 4 includes the blade tip 40, the leading edge 41 and the trailing edge 42. Between the blade tip 40 and the compressor casing 2 is the gap 43.

In the radial direction, the shape of the duct 20 is optional (cf. FIGS. 4*a-d*). Not optional however is the length l of the duct 20. The maximum length $l_{max}$ of the duct 20 is defined by the minimum aerodynamic speed $n_{min}$ of the compressor at which the duct 20 shall have effect, cf. equation (1). According to equation (1), the maximum length $l_{max}$ of the duct 20 is provided such that a standing wave is produced in the duct 20. The maximum length $l_{max}$ here lies on the centerline 23 of the duct 20.

$$l_{max} = \left(\frac{1}{2}k + \frac{1}{4}\right)\frac{\sqrt{\kappa R}}{n_{min} z} \tag{1}$$

with $l_{max}$ being the maximum length of the duct 20, k any natural number, κ the isentropic exponent, R the specific gas constant, $n_{min}$ the minimum aerodynamic speed, z the number of blades of the rotor blade row.

The aerodynamic speed n is obtained by dividing the mechanical compressor speed by the root of the compressor inlet temperature. This aerodynamic speed n is available to the engine computer. Factor k is any natural number (0, 1, 2, . . . ) by which the length l of the duct 20 can be increased without affecting its effectiveness. Factor κ is the isentropic exponent, R the specific gas constant and z the number of blades of the rotor blade row at which the duct 20 has effect on the flow.

As the compressor speed is changed, the length l of the duct 20 is varied in dependence of the aerodynamic speed n in accordance with equation (2).

$$l(n) = \left(\frac{1}{2}k + \frac{1}{4}\right)\frac{\sqrt{\kappa R}}{nz} \tag{2}$$

with l being the length of the duct 20, k any natural number,

κ the isentropic exponent,

R the specific gas constant, n the aerodynamic speed, z the number of blades of the rotor blade row.

The minimum length $l_{min}$ of the duct 20 here depends on the maximum aerodynamic speed $n_{max}$ at which the compressor is operated, cf. equation (3). It shall here be noted that $k_{min} \leqq k$.

$$l_{min} = \left(\frac{1}{2}k_{min} + \frac{1}{4}\right)\frac{\sqrt{\kappa R}}{n_{max}z} \tag{3}$$

with $l_{min}$ being the minimum length of the duct 20, k any natural number, κ the isentropic exponent, R the specific gas constant, $n_{max}$ the maximum aerodynamic speed, z the number of blades of the rotor blade row.

The length l of the duct 20 is adjusted by the piston 30 moving in that portion of the duct 20 which lies between the minimum length $l_{min}$ and the maximum length $l_{max}$ of the duct 20. Accordingly, the piston 30 is used for varying the length l of the duct 20 such that, in accordance with equation (2), the set length l matches the actual aerodynamic speed n. The travel of the piston 30 is $s=l_{max}-l_{min}$ In the area of travel s of the piston 30, the duct 20 is designed such that the piston 30 will fit, i.e. the duct 20 is straight and has a constant cross-section in this area. Movement of the piston 30 is controlled by the aerodynamic speed n of the compressor and is effected by suitable mechanics, for example electrically (e.g. by a stepping motor), hydraulically or pneumatically.

In operation, the length l of the duct 20 is to be selected such that a standing wave is produced therein. To set the length l, the movable piston 30 is traversed between the minimum length $l_{min}$ and the maximum length $l_{max}$ of the duct 20. The travel s of the piston 30 depends on the aerodynamic speed n, as described above. For optimum control of the flow, two quantities are to be matched with each other. These are the blade passing frequency of the rotor blade row to be influenced and the volume of the duct 20. Each rotor blade 4 of the rotor blade row is surrounded by a static pressure field. This pressure field moves past the first end 21 of the duct 20, exciting vibrations of the air column in the duct 20. The piston 30 enables the volume of the duct 20 to be changed. In consequence thereof, the natural frequency of the air column in the duct 20 is also varied.

If the volume is now set such to the compressor speed that the blade passing frequency concurs with a multiple of the natural frequency of the air column in the duct 20, a case of resonance occurs and a standing wave with maximum amplitude is produced in the duct 20. At the second end 22 of the duct 20, the standing wave has a node at the piston 30, and the speed is zero. At the first end 21 of the duct 20, the standing wave has an antinode. Accordingly, vibration of the air column will here be maximum. At the first end 21 of the duct 20, a pulsating mass flow will form which stabilizes the flow in the area of the blade tips 40 of the rotor blades 4.

LIST OF REFERENCE NUMERALS

1 Compressor
2 Compressor casing
3 Compressor duct
4 Rotor blade
5 Stator vane
6 Actuating device
7 Air
8 Air
9 Inner bypass casing
10 Duct
11 Tapping point
12 Injection point
13 Depression
20 Duct
21 First end
22 Second end
23 Centerline
$l_{pos}$ Positional area
30 Piston
$l_{min}$ Minimum length
$l_{max}$ Maximum length
s Travel of the piston
40 Blade tip
41 Leading edge
42 Trailing edge
43 Gap
$l_{ax}$ Chord length

What is claimed is:

1. A fluid-flow machine casing, comprising:

at least one casing structure for stabilizing flow in an area of blade tips of rotor blades of the fluid-flow machine, the casing structure being provided in at least one stage on an inner circumference of the casing, wherein the casing structure is configured as a duct, which includes a first end and a second end, the first end issuing into an interior of the casing in the area of the blade tips of a rotor blade row and the second end being closed;

a mechanism for speed-dependable adjusting a length l of the duct at the second end in a continuous range between a minimum length $l_{min}$ and a maximum length $l_{max}$.

2. The casing of claim 1, wherein the duct is arranged essentially radially to the inner circumference of the casing.

3. The casing of claim 1, wherein the duct is rectilinear at least in the range between $l_{min}$ and $l_{max}$ and has a constant cross-section in this range, and further comprising a piston which is movably positioned in the duct in the range between $l_{min}$ and $l_{max}$.

4. The casing of claim 3, and further comprising at least one of an electric, hydraulic and pneumatic drive for controlling the position of the piston.

5. The casing of claim 4, wherein the duct includes a constriction at the first end.

6. The casing of claim 1, wherein the duct is arranged angularly to a longitudinal axis of the casing.

7. The casing of claim 1, wherein the duct is curvilinear outside of the range between $l_{min}$ and $l_{max}$.

8. The casing of claim 1, wherein the duct is curvilinear in an area of the first end and parallel to a longitudinal axis of the casing in the range between $l_{min}$ and $l_{max}$.

9. The casing of claim 1, wherein the position of the first end of the duct is between a trailing edge of the rotor blade and a distance measured from the trailing edge of the rotor blade which is 1.3 times an axial chord length $l_{ax}$ of the rotor blade at the blade tip.

10. The casing of claim 1, wherein the casing is for a compressor of a gas turbine.

11. A method for stabilizing flow in an area of blade tips of rotor blades in a fluid-flow machine, comprising:

providing a duct in a casing of the fluid-flow machine, the duct having a first end issuing from an inner circumference of the casing into an interior of the casing in the area of the blade tips of a rotor blade row and a second end being closed;

moving a static pressure field forming on each rotor blade into the first end of the duct during rotation of the rotor blade and exciting vibrations of a fluid column in the duct;

producing a standing wave in the duct to form a pulsating mass flow at the first end of the duct;

adjusting a natural frequency of the fluid column to be speed-dependent by adjusting a length l of the duct.

12. The method of claim 11, and further comprising: producing the standing wave in the natural frequency of the fluid column and matching that to a blade passing frequency such that the natural frequency of the fluid column concurs with a multiple of a blade passing frequency of the rotor blades.

13. The method of claim 12, and further comprising calculating the length l of the duct using the formula $$l(n) = \left(\frac{1}{2}k + \frac{1}{4}\right)\frac{\sqrt{\kappa R}}{nz},$$

with l being the length of the duct, k any natural number,

□ an isentropic exponent,

R a specific gas constant, n an aerodynamic speed of a compressor rotor, and z a number of blades of the rotor blade row.

14. The method of claim 13, and further comprising calculating a minimum length $l_{min}$ of the duct using the formula $$l_{min} = \left(\frac{1}{2}k_{min} + \frac{1}{4}\right)\frac{\sqrt{\kappa R}}{n_{max}z} \text{ with } k_{min} \le k,$$

and with $l_{min}$ being the minimum length of the duct, $k_{min}$ any natural number, □ the isentropic exponent, R the specific gas constant, $n_{max}$ the maximum aerodynamic speed of the compressor rotor, and z the number of blades of the rotor blade row.

15. The method of claim 13, and further comprising calculating a maximum length $l_{max}$ of the duct using the formula $$l_{max} = \left(\frac{1}{2}k + \frac{1}{4}\right)\frac{\sqrt{\kappa R}}{n_{min}z},$$

with $l_{max}$ being the maximum length of the duct, k any natural number,

□ the isentropic exponent,

R the specific gas constant, $n_{min}$ the minimum aerodynamic speed of the compressor rotor, and z the number of blades of the rotor blade row.

16. The method of claim 11, and further comprising calculating the length l of the duct using the formula $$l(n) = \left(\frac{1}{2}k + \frac{1}{4}\right)\frac{\sqrt{\kappa R}}{nz},$$

with l being the length of the duct, k any natural number,

□ an isentropic exponent,

R a specific gas constant, n an aerodynamic speed of a compressor rotor, and z a number of blades of the rotor blade row.

17. The method of claim 16, and further comprising calculating a minimum length $l_{min}$ of the duct using the formula $$l_{min} = \left(\frac{1}{2}k_{min} + \frac{1}{4}\right)\frac{\sqrt{\kappa R}}{n_{max}z} \text{ with } k_{min} \le k,$$

and with $l_{min}$ being the minimum length of the duct, $k_{min}$ any natural number, □ the isentropic exponent, R the specific gas constant, $n_{max}$ the maximum aerodynamic speed of the compressor rotor, and z the number of blades of the rotor blade row.

18. The method of claim 16, and further comprising calculating a maximum length $l_{max}$ of the duct using the formula $$l_{max} = \left(\frac{1}{2}k + \frac{1}{4}\right)\frac{\sqrt{\kappa R}}{n_{min}z},$$

with $l_{max}$ being the maximum length of the duct, k any natural number,

□ the isentropic exponent,

R the specific gas constant, $n_{min}$ the minimum aerodynamic speed of the compressor rotor, and z the number of blades of the rotor blade row.

* * * * *